US008683763B2

(12) United States Patent
Shriver

(10) Patent No.: US 8,683,763 B2
(45) Date of Patent: Apr. 1, 2014

(54) METHODS AND APPARATUSES FOR POSITIONING AND SECURING SAFING INSULATION

(75) Inventor: James Shriver, Wabash, IN (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 277 days.

(21) Appl. No.: 12/609,106

(22) Filed: Oct. 30, 2009

(65) Prior Publication Data

US 2010/0107532 A1 May 6, 2010

Related U.S. Application Data

(60) Provisional application No. 61/109,949, filed on Oct. 31, 2008.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |

(52) U.S. Cl.
USPC ..... 52/235; 52/404.2; 52/407.5; 52/407.2

(58) Field of Classification Search
USPC ..... 52/234, 573.1, 241, 220.8, 235, 236.3, 52/236.6, 236.7, 236.8, 236.9, 262, 264, 52/481.1, 481.2, 404.2, 407.2, 407.5, 511, 52/506.05
See application file for complete search history.

(56) References Cited

U.S. PATENT DOCUMENTS

| | | | |
|---|---|---|---|
| 2,007,683 | A | 7/1935 | Kreutzer |
| 2,391,792 | A | 12/1945 | Miles et al. |
| 2,592,634 | A | 4/1952 | Wilson |
| 3,462,901 | A | 8/1969 | Jamgochian |
| 3,604,167 | A | 9/1971 | Hays |
| 3,715,848 | A | 2/1973 | Jordan |
| 3,786,604 | A | 1/1974 | Kramer |

(Continued)

FOREIGN PATENT DOCUMENTS

| | | |
|---|---|---|
| GB | 2 142 952 | 1/1985 |
| WO | 93/23245 | 11/1993 |

OTHER PUBLICATIONS

Office Action dated May 25, 2011 in corresponding Canadian Application No. 2,684,179.

(Continued)

*Primary Examiner* — Chi Q Nguyen
(74) *Attorney, Agent, or Firm* — Calfee, Halter & Griswold LLP

(57) ABSTRACT

The present invention provides methods and apparatuses for securing safing insulation in the gap formed between a spandrel and a slab. Additionally, the present invention eliminates the need for stiffening tees and/or stiffening brackets. In one exemplary embodiment, the present invention utilizes a first portion of safing secured to spandrel insulation positioned in an exterior wall structure and a second portion of safing insulation positioned adjacent to the first portion of safing insulation and between the spandrel insulation and the slab. By fixedly securing the first portion of safing insulation to the spandrel insulation, any deformation of the spandrel insulation caused by the forces exerted by the compressed second portion of safing insulation on spandrel insulation results in the first portion of safing insulation moving with the spandrel insulation.

24 Claims, 4 Drawing Sheets

(56) References Cited

U.S. PATENT DOCUMENTS

| | | | | |
|---|---|---|---|---|
| 4,449,341 | A | 5/1984 | Taglianetti et al. | |
| 4,546,582 | A | 10/1985 | Gartner | |
| 4,677,731 | A | 7/1987 | Sommerer et al. | |
| 4,917,554 | A | 4/1990 | Bronn | |
| 4,977,719 | A | 12/1990 | LaRoche et al. | |
| 5,063,718 | A * | 11/1991 | Nonis | 52/235 |
| 5,765,332 | A | 6/1998 | Landin et al. | |
| 6,035,584 | A | 3/2000 | Barreto | |
| 6,698,146 | B2 | 3/2004 | Morgan et al. | |
| 6,783,345 | B2 | 8/2004 | Morgan et al. | |
| 6,857,233 | B2 | 2/2005 | Farag | |
| 7,043,880 | B2 | 5/2006 | Morgan et al. | |
| 7,152,385 | B2 | 12/2006 | Morgan et al. | |
| 7,424,793 | B1 | 9/2008 | Shriver | |
| 7,644,549 | B2 * | 1/2010 | Speck | 52/235 |
| 7,765,753 | B1 * | 8/2010 | Shriver | 52/235 |
| 7,827,746 | B2 * | 11/2010 | Speck | 52/235 |
| 7,856,775 | B2 * | 12/2010 | Stahl, Jr. | 52/232 |
| 7,886,491 | B1 * | 2/2011 | Shriver | 52/235 |
| 2007/0204540 | A1 | 9/2007 | Stahl, Sr. et al. | |
| 2009/0126297 | A1 | 5/2009 | Stahl, Jr. | |

OTHER PUBLICATIONS

Product Information, Thermafiber, Inc., "Impasse Curtain Wall Insulation System", Jul. 2005.
Office action from U.S. Appl. No. 12/609,643 dated Dec. 5, 2011.
Office action from U.S. Appl. No. 12/609,643 dated Aug. 29, 2012.
Notice of Allowance from U.S. Appl. No. 12/609,643 dated Jul. 10, 2013.
Office action from Canadian Application No. 2,684,179 dated Jun. 26, 2013.
Thermafiber Smoke Seal Compound, Submittal Sheet 07840, United States Gypsum Company, 1993.
3M FireDam Spray 200, Product Data, 3M 2006.
SpecSeal Fast Tack Firestop Spray, Product Data Sheet, Specified Technologies, Inc. 2007.
SpecSeal Series AS 2000 Elastomeric Spray, Product Data Sheet, Specified Technologies, Inc. 2008.
Hilti CP 672 joint spray, Item No. 00315267, Hilti Corporation, 2008.
Product Data Sheet, Metacaulk 1200, Metacaulk 1220 SL, Metacaulk 1200 Caulk grade, Rectorseal, May 2006.
Product Data Sheet BIOSTOP 750 Spray Applied Mastic, BIOSTOP 7850 SL, BIOSTOP 750 Caulk Grade, Rectorseal, May 2006.

* cited by examiner

METHODS AND APPARATUSES FOR POSITIONING AND SECURING SAFING INSULATION

BACKGROUND

1. Field of the Invention

The present invention relates to insulation and, particularly, to methods and apparatuses for securing safing insulation.

2. Description of the Related Art

Modern, multiple story buildings may be formed with an external wall structure that is secured to a floor slab. The external wall structure, or curtainwall, is secured to the slab, which is made of concrete, at a distance spaced away from the slab. By creating a gap between the slab and the curtainwall, proper alignment of the curtainwall is ensured. For example, in the event that the slab for a particular floor is not entirely straight or the slabs of adjacent floors are not properly aligned, the size of the gap between the curtainwall and a slab may be adjusted at various points along the slab to align the curtainwall so that it is substantially straight along the entire length and/or height of the building.

While the gap created between the curtainwall and the slabs of a building may be necessary to allow for proper alignment of the curtainwall, in the event of a fire, smoke, hot gasses, and/or flames may pass from one floor to another through the gap between the curtainwall and the slabs. In order to prevent smoke, hot gasses, and/or fire from passing freely through this gap, safing insulation may be positioned between the slabs and spandrels of the curtainwall. Specifically, the spandrel areas of the curtainwall may be backed by a layer of spandrel insulation and the safing may be positioned between the spandrel insulation and the slabs in order to fill the gap between the spandrels and the slabs.

In order to increase the ability of the safing insulation to prevent the passage of smoke, hot gasses, and/or fire, the safing insulation, which may be manufactured from mineral wool, for example, is compressed before being inserted between the spandrel insulation and the slabs. The safing insulation is then maintained in a compressed condition between the spandrel insulation and the slabs. By maintaining the safing insulation in a compressed condition, the density of the safing insulation is increased, which increases the ability of the safing insulation to prevent the passage of smoke, hot gasses, and/or fire therethrough. However, due to the compression of the safing insulation, the safing insulation exerts pressure on the spandrel insulation that may cause the spandrel insulation to bend, bow, or otherwise deform. As a result of the deformation of the spandrel insulation, the safing insulation may decompress, which decreases the ability of the safing insulation to prevent the passage of smoke, hot gasses, and/or fire therethrough.

In order to overcome this problem, stiffening brackets or stiffening tees have been secured to the spandrel insulation adjacent to the safing insulation. These stiffening tees or stiffening brackets may be formed of metal and may extend between opposing mullions in the exterior wall structure of the building to provide sufficient rigidity to the spandrel insulation. In this manner, the stiffening tees or stiffening brackets prevent the deformation of spandrel insulation by resisting the forces exerted on the spandrel insulation by the compressed safing insulation. While stiffening tees and/or stiffening brackets are effective, stiffening tees and/or stiffening brackets are difficult to position and secure. Specifically, due to the small space existing in the gap formed between the perimeter edge of the slab and the spandrel insulation, the amount of time and effort needed to properly install the stiffening tees and/or stiffening brackets is increased.

SUMMARY

The present invention provides methods and apparatuses for securing safing insulation in the gap formed between a spandrel and a slab. Additionally, the present invention eliminates the need for stiffening tees and/or stiffening brackets. In one exemplary embodiment, the present invention utilizes an additional portion of spandrel insulation that is secured to the main spandrel insulation positioned against the spandrels of an exterior wall structure. This additional portion of spandrel insulation is positioned adjacent to a portion of compressed safing insulation positioned between the spandrel insulation and the slab. By fixedly securing this additional portion of spandrel insulation adjacent to the compressed safing insulation, any deformation of the main spandrel insulation that is caused by the forces exerted by the compressed safing insulation on the main spandrel insulation results in the additional portion of spandrel insulation moving in conjunction with the deformed main spandrel insulation. As a result, the deformation of the main spandrel insulation does not result in the creation of a gap between the compressed safing insulation and the spandrel insulation. Thus, the safing insulation continues to achieve its desired level of effectiveness by preventing smoke, hot gasses, and/or fire from passing through the safing insulation.

In another exemplary embodiment, a second, additional portion of spandrel insulation is positioned below and adjacent to the compressed safing insulation. The second portion of spandrel insulation is also secured to the main spandrel insulation that is positioned adjacent to the spandrels of the exterior wall structure. As a result, the second portion of spandrel insulation provides additional smoke, hot gas, and/or fire protection by providing a further barrier along the junction between the safing insulation and the main spandrel insulation.

In another exemplary embodiment, a portion of safing insulation is secured in the gap between the spandrel insulation and the slab. The safing insulation is positioned in a compressed condition and extends entirely between the main spandrel insulation and the slab. The compressed safing insulation is secured in position using a Z-clip. An additional portion of spandrel insulation is secured to the main spandrel insulation, which is positioned adjacent to the spandrels, in a position that is below and adjacent to the safing insulation. Thus, in this embodiment, if the compressed safing insulation causes deformation of the main spandrel insulation, the additional portion of spandrel insulation will deform with the main spandrel insulation and will prevent the passage of smoke, hot gasses, and/or fire through the junction between the main spandrel insulation and the safing insulation. In an alternative embodiment, a compression clip is used instead of a Z-clip to secure the compressed safing insulation in position.

In another exemplary embodiment, needled felt, in conjunction with loose insulation material, is used to create a smoke, hot gas, and/or fire barrier in the gap between the main spandrel insulation and the slab. In one exemplary embodiment, a first end of a portion of needled felt is secured to a slab utilizing a modified Z-clip and the second end of the portion of needled felt is secured to the main spandrel insulation with a predetermined amount of slack in the needled felt. In this manner, the needled felt forms a U-shaped trough in the gap between the main spandrel insulation and the slab. Positioned within this trough is loose insulation material. In this manner, if the main spandrel insulation is deformed, the needled felt will expand and/or contract therewith. Thus, as the needled felt moves, the loose mineral wool will correspondingly increase and decrease in depth but, at all times, will continue to provide a barrier to smoke, hot gasses, and/or fire.

In another exemplary embodiment, a portion of safing insulation is secured in the gap between the main spandrel insulation and the slab. This portion of safing insulation is positioned in a compressed condition and extends entirely between the main spandrel insulation and the slab. The safing insulation is secured in position using a compression clip. An additional portion of spandrel insulation is positioned below and adjacent to the safing insulation and is secured to the safing insulation. The additional portion of spandrel insulation is sized to extend from the main spandrel insulation positioned adjacent to the spandrels of the exterior wall system across the junction between the safing insulation and the slab. Thus, the additional portion of spandrel insulation prevents the passage of smoke, hot gasses, and/or fire through the junction between the compressed safing insulation and the slab. Further, a second, additional portion of spandrel insulation may be positioned beneath and adjacent to the first, additional portion of spandrel insulation and secured to the main spandrel insulation positioned adjacent to the spandrels. Thus, irrespective of the position of the main spandrel insulation, the second, additional portion of spandrel insulation prevents the passage of smoke, hot gasses, and/or fire through the junction between the first, additional portion of spandrel insulation, the safing insulation, and the main spandrel insulation.

In one form thereof, the present invention provides a fire containment system for use in a building having an exterior wall system. The exterior wall system has a spandrel and is positioned a distance from a slab, wherein the distance between the spandrel and the slab defines a gap therebetween. The fire containment system includes a portion of main spandrel insulation positioned within the gap between the spandrel and the slab. The first containment system also includes a portion of compressed safing insulation positioned within the gap between the portion of main spandrel insulation and the slab. The portion of compressed safing insulation forms a spandrel junction with the portion of main spandrel insulation and a slab junction with the slab. The portion of compressed safing insulation has an upper surface and a lower surface. The fire containment system further includes a first, additional portion of spandrel insulation positioned adjacent to and abutting the portion of main spandrel insulation. The first, additional portion of spandrel insulation is positioned adjacent to and abutting one of the upper surface and the lower surface of the portion of compressed safing insulation. The first, additional portion of spandrel insulation is fixedly secured to the portion of main spandrel insulation, wherein movement of the portion of main spandrel insulation results in corresponding movement of the first, additional portion of spandrel insulation, and wherein movement of the portion of main spandrel insulation in a direction away from the slab creates a space at the spandrel junction and the first, additional portion of spandrel insulation restricts the passage of smoke, hot gasses, and fire through the space created at the spandrel junction.

In another form thereof, the present invention provides a fire containment system for use in a building having an exterior wall system. The exterior wall system has a spandrel and is positioned a distance from a slab, wherein the distance between the spandrel and the slab defines a gap therebetween. The fire containment system includes a portion of main spandrel insulation positioned within the gap between the spandrel and the slab. The fire containment system also includes a portion of compressed safing insulation positioned within the gap between the main spandrel insulation and the slab. The portion of compressed safing insulation forms a spandrel junction with the portion of main spandrel insulation and a slab junction with the slab. The portion of compressed safing insulation has an upper surface and a lower surface. The fire containment system also includes a first, additional portion of spandrel insulation positioned adjacent to and abutting one of the upper surface and the lower surface of the portion of compressed safing insulation. The first, additional portion of spandrel insulation is fixedly secured to the portion of compressed safing insulation. The first, additional portion of spandrel insulation extending across the slab junction formed between the portion of compressed safing insulation and the slab, wherein the first, additional portion of spandrel insulation restricts the passage of smoke, hot gasses, and fire through the second junction.

BRIEF DESCRIPTION OF THE DRAWINGS

The above-mentioned and other features and advantages of this invention, and the manner of attaining them, will become more apparent and the invention itself will be better understood by reference to the following descriptions of embodiments of the invention taken in conjunction with the accompanying drawings, wherein.

Corresponding reference characters indicate corresponding parts throughout the several views. The exemplifications set out herein illustrate preferred embodiments of the invention and such exemplifications are not to be construed as limiting the scope of the invention in any manner.

DETAILED DESCRIPTION

Figure 1:
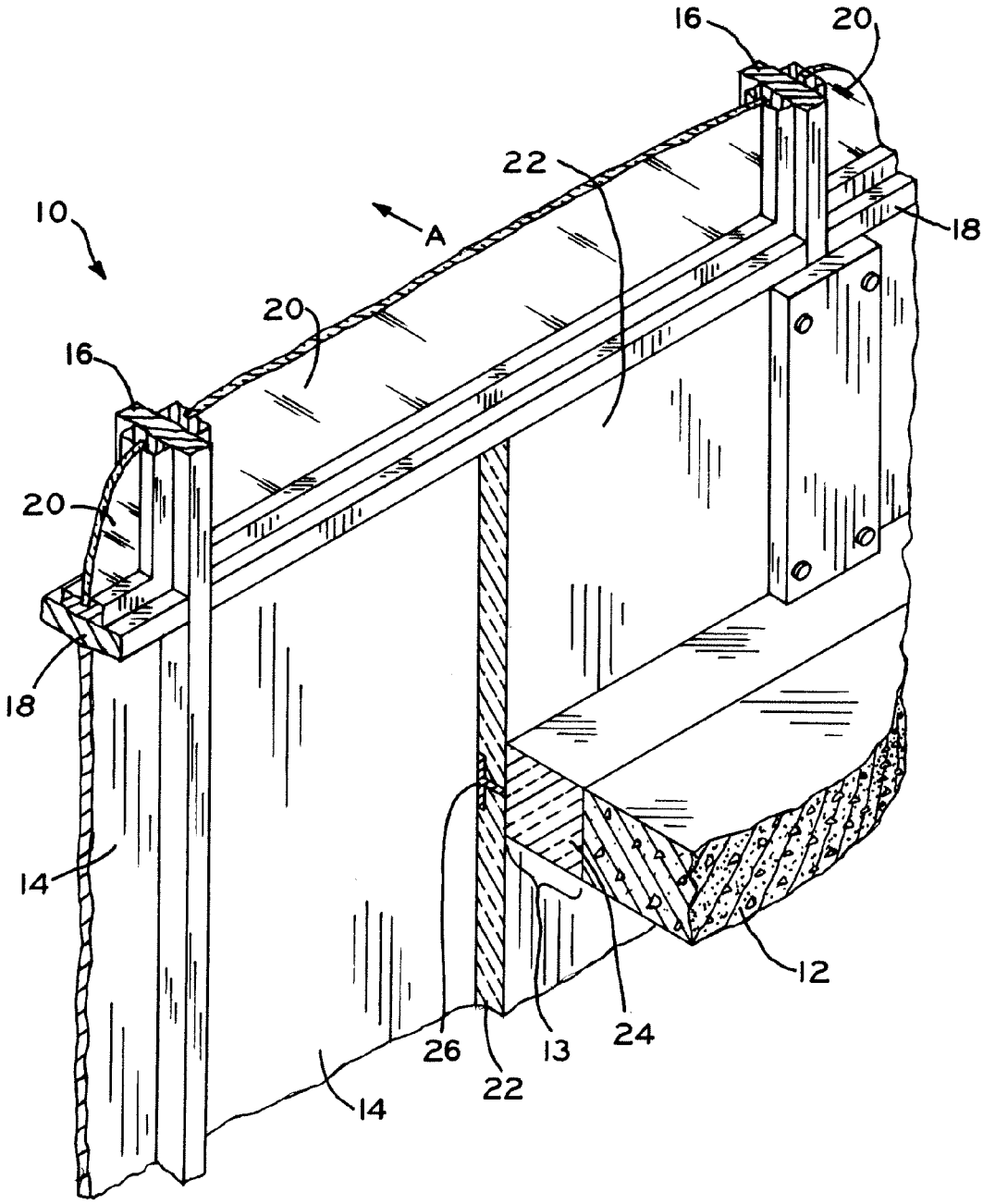
FIG. 1 is a fragmentary, partial cross-sectional perspective view of an exterior wall system secured to a slab.

Referring to FIG. 1, an exterior wall system is depicted generally at numeral 10. Wall system 10 is connected to slab 12, which forms one of the floors of a multi-floor building. Wall system 10 includes spandrels 14 that, in one exemplary embodiment, define the exterior facade of the building. In one exemplary embodiment, spandrels 14 cover the area between the sill of a first vision glass installation and the head of a second vision glass installation. Spandrel 14 is secured to mullions 16, which provide the vertical framework for wall system 10. Extending between mullions 16 are transoms 18, which provide the horizontal framework for wall system 10. Additionally, vision glass 20 may be positioned between portions of mullions 16 and transoms 18. In this manner, spandrels 14 and vision glass 20, provide the visible, aesthetic features of exterior wall system 10.

Referring to FIG. 1, main spandrel insulation 22 is positioned between spandrels 14 and slab 12 and, in one exemplary embodiment, is adjacent to spandrels 14. In one exemplary embodiment, the spandrel insulation may be FIRESPAN™ insulation commercially available from Thermafiber, Inc. FIRESPAN™ is a trademark of Thermafiber, Inc., of Wabash, Ind. Main spandrel insulation 22 provides a first layer of fire protection for exterior wall system 10. As discussed above, wall system 10 is positioned at a distance spaced from slab 12 and secured thereto. As a result, gap 13 is created between slab 12 and wall system 10. Thus, even though main spandrel insulation 22 is properly positioned, in the event of a fire, smoke, hot gasses, and/or flames may travel through gap 13 between slab 12 and wall system 10 and pass between adjacent floors of the building. In order to prevent and/or delay the passage of smoke, hot gasses, and/or fire between adjacent floors of a building, safing insulation is utilized.

As shown in FIG. 1, safing insulation 24 is positioned between main spandrel insulation 22 and slab 12. In one exemplary embodiment, safing insulation 24 is mineral wool insulation. For example, safing insulation 24 may be Thermafiber® Safing Insulation, commercially available from Thermafiber, Inc., of Wabash, Ind. Thermafiber® is a registered trademark of Thermafiber, Inc., of Wabash, Ind. In order to increase the density of safing insulation 24 and, correspondingly, increase the ability of safing insulation 24 to delay and/or prevent the passage of smoke, hot gasses, and/or fire through gap 13, safing insulation 24 is compressed between slab 12 and main spandrel insulation 22. Specifically, safing insulation 24 may be compressed manually and then inserted between slab 12 and main spandrel insulation 22. Once properly positioned, safing insulation 24 may expand to fill the gap between main spandrel insulation 22 and slab 12. However, even though safing insulation 24 has slightly expanded, safing insulation 24 still remains in a compressed condition in which it has an increased density as compared to its uncompressed, i.e., neutral, condition.

Due to the compression of safing insulation 24, safing insulation 24 exerts a force on both slab 12 and main spandrel insulation 22. As a result of the force applied by safing insulation 24 to main spandrel insulation 22, main spandrel insulation 22 may be deformed. For example, main spandrel insulation 22 may deform in the direction of arrow A of FIG. 1, toward spandrel 14. As a result of the deformation of main spandrel insulation 22, safing insulation 24 expands and, corresponding, decreases in density. As a result of the decrease in density of safing insulation 24, safing insulation 24 may no longer be able to delay and/or prevent the passage of smoke and/or fire through safing insulation 24. Additionally, due to the loss of compression of safing insulation 24, a breach may be created between safing insulation 24 and main spandrel insulation 22. In fact, if the deformation of safing insulation 24 is severe, safing insulation 24 may fall out of gap 13. Moreover, even if safing insulation 24 is maintained in gap 13 and is still able to delay the passage of smoke, hot gasses, and/or fire through gap 13, the amount of time during which safing insulation 24 is able to delay the passage of smoke, hot gasses, and/or fire may be lessened.

In order to prevent main spandrel insulation 22 from deforming due to the forces exerted by compressed safing insulation 24, support structure, such as stiffening brackets and/or stiffening tees 26 shown in FIG. 1, may be used. This support structure extends between opposing mullions 16 and provide a rigid area against which safing insulation 24 may press. For example, stiffening tees 26 are sufficiently strong to resist deformation due to the forces exerted by compressed safing insulation 24. Thus, by utilizing support structure, such as stiffening tees 26 or other mechanical backer bars, such as metal angles or hat channel, deformation of main spandrel insulation 22 is substantially entirely prevented.

While stiffening tees 26 are effective, in order to install stiffening tees 26, technicians are forced to work within gap 13 provided between slab 12 and spandrel 14. Not only is gap 13 exceedingly narrow, gap 13 is also formed extremely close to wall system 10. Thus, in order to insert stiffening tees 26, technicians must maneuver and secure the same within extremely tight areas. This results in an increase in technician installation time, which increases the overall cost of the installation of wall system 10. Moreover, these costs cannot be avoided, as failure to utilize stiffening tees 26 may decrease the overall fire protection of the building.

Figure 2:
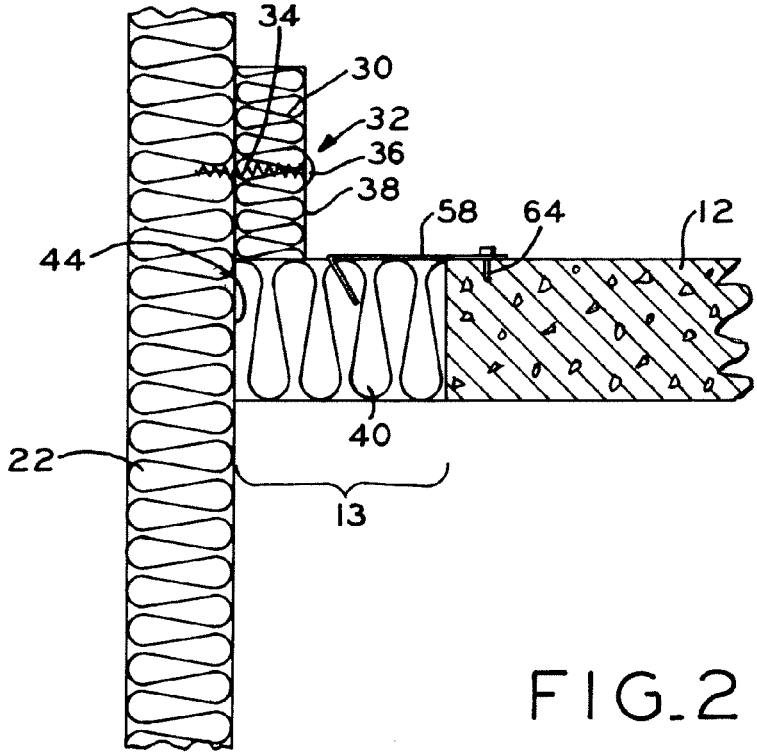
FIG. 2 is a fragmentary, cross-sectional view of an insulation system according to an exemplary embodiment of the present invention.

Referring to FIGS. 2-6, the present invention provides for the securement of a portion of spandrel insulation directly to main spandrel insulation 22, eliminating the need for stiffening tees 26. Referring to FIG. 2, in one exemplary embodiment, a portion of spandrel insulation in the form of fixed spandrel insulation 30 is secured to main spandrel insulation 22 by spiral anchor 32. Fixed spandrel insulation 30 is sized to extend substantially entirely between opposing mullions 16 (FIG. 1). Spiral anchor 32 includes body 34 and head 36. Body 34 of spiral anchor 32 is formed as a spiral-shaped wire with head 36 connected thereto. Head 36 has a substantially flat, broad configuration that has a diameter greater than the diameter of shaft 34. Thus, with body 34 of spiral anchor 32 positioned through fixed spandrel insulation 30 and main spandrel insulation 22, head 36 of spiral anchor 32 is positioned against interior surface 38 of fixed spandrel insulation 30. As a result, fixed spandrel insulation 30 is captured between head 36 of spiral anchor 32 and main spandrel insulation 22.

Referring to FIG. 2, compressed safing insulation 40 is positioned between main spandrel insulation 22 and slab 12 at a location that is below and adjacent to the desired position of fixed spandrel insulation 30. Compressed safing insulation 40 may be secured in position by a compression clip, such as compression clip 58 described in detail below. In another exemplary embodiment, compressed safing insulation 40 is inserted between main spandrel insulation 22 and slab 12 at a position below and adjacent to fixed spandrel insulation 30. By utilizing fixed spandrel insulation 30, in the event that compressed safing insulation 40 causes deformation of main spandrel insulation 22, fixed spandrel insulation 30 will move with main spandrel insulation 22 and prevent the formation of a gap at junction 44 between compressed safing insulation 40 and main spandrel insulation 22. Additionally, fixed spandrel insulation 30 provides addition material through which smoke, hot gasses, and/or fire must travel to pass through gap 13. As a result, even if main spandrel insulation 22 is slightly deformed, the ability of insulation 30, 40 to delay and/or prevent the passage of smoke, hot gasses, and/or fire through gap 13 is substantially maintained.

Figure 3:
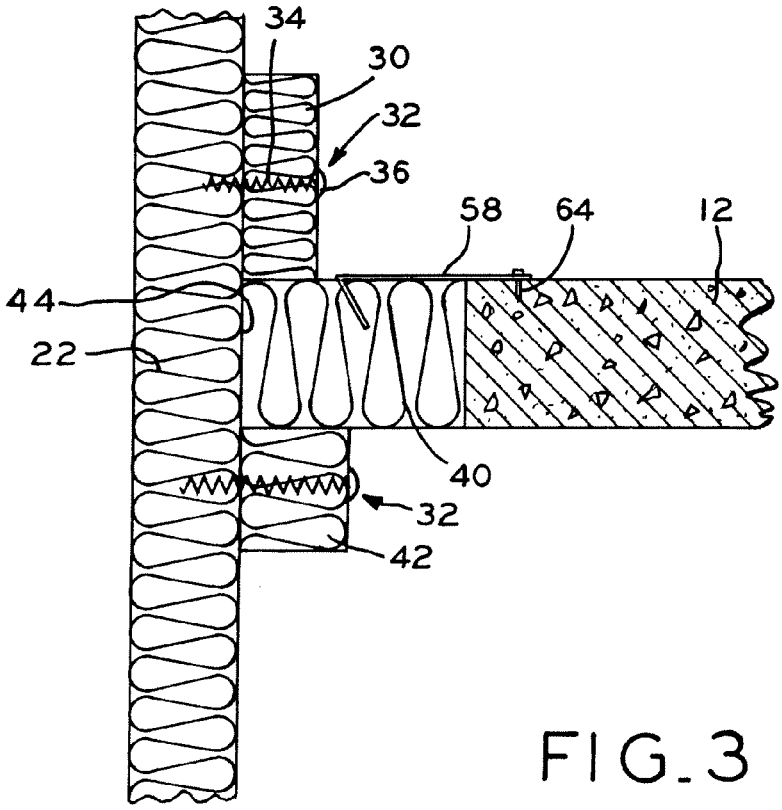
FIG. 3 is a fragmentary, cross-sectional view of another exemplary embodiment of an insulation system.

In another exemplary embodiment, shown in FIG. 3, a second portion of fixed spandrel insulation, denoted as fixed spandrel insulation 42, is secured to main spandrel insulation 22 by another spiral anchor 32 at a position that is below and adjacent to compressed safing insulation 40. Similar to fixed spandrel insulation 30, fixed spandrel insulation 42 is also sized to extend substantially entirely between opposing mullions 16 (FIG. 1). Thus, in the event compressed safing insulation 40 deforms main spandrel insulation 22, fixed spandrel insulation 42 provides an additional barrier to the passage of smoke, hot gasses, and/or fire through junction 44 between main spandrel insulation 22 and compressed safing insulation 40. Additionally, fixed spandrel insulation 42 may also provide support to compressed safing insulation 40 and maintain the same in position between slab 12 and main spandrel insulation 22, i.e., fixed spandrel insulation 42 may prevent compressed safing insulation 40 from falling out of the gap between slab 12 and main spandrel insulation 22 in the event of severe deformation of main spandrel insulation 22.

Figure 4:
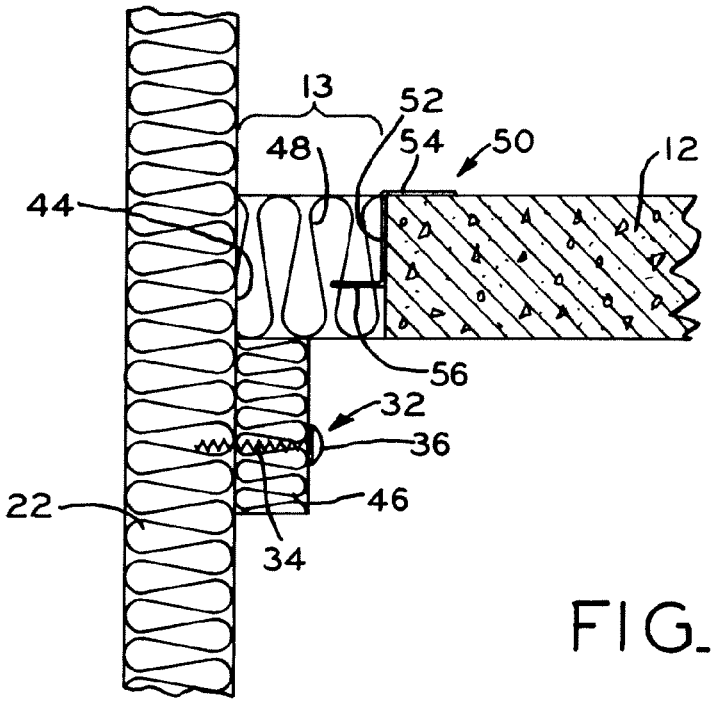
FIG. 4 is a fragmentary, cross-sectional view of another exemplary embodiment of an insulation system.

Referring to FIG. 4, another exemplary embodiment is shown including fixed spandrel insulation 46 positioned below compressed safing insulation 48. Fixed spandrel insulation 46 is sized to extend substantially entirely between opposing mullions 16 (FIG. 1). In this embodiment, compressed safing insulation 48 extends between slab 12 and main spandrel insulation 22 and is secured in position using Z-clip 50. Z-clip 50 includes vertical, central body portion 52, horizontal upper arm 54, and horizontal lower arm 56. Arms 54, 56 extend from body 52 in opposite directions. In this manner, upper arm 54 of Z-clip 50 rests against the upper surface of slab 12 and lower arm 56 of Z-clip 50 embeds in compressed safing insulation 48. By utilizing Z-clip 50, compressed safing insulation 48 is maintained in position between slab 12 and main spandrel insulation 22. Fixed spandrel insulation 46 is positioned below safing insulation 48 and secured directly to main spandrel insulation 22 by spiral anchor 32. In this embodiment, both Z-clip 50 and fixed spandrel insulation 46 support compressed safing insulation 48 and help to maintain safing insulation 48 within the gap between main spandrel insulation 22 and slab 12.

In this embodiment, in the event that compressed safing insulation 48 causes deformation of main spandrel insulation 22, fixed spandrel insulation 46 will move with main spandrel insulation 22. As a result, any gap formed at junction 44 between main spandrel insulation 22 and compressed safing insulation 48 will be prevented from allowing the passage of smoke, hot gasses, and/or fire therethrough by fixed spandrel insulation 46. Additionally, irrespective of the amount of deformation of main spandrel insulation 22 caused by compressed safing insulation 48, the location of fixed spandrel insulation 46 and the use of Z-clip 50 will prevent compressed safing insulation 48 from falling out or otherwise becoming dislodged from between slab 12 and main spandrel insulation 22, as indicated above.

Figure 6:
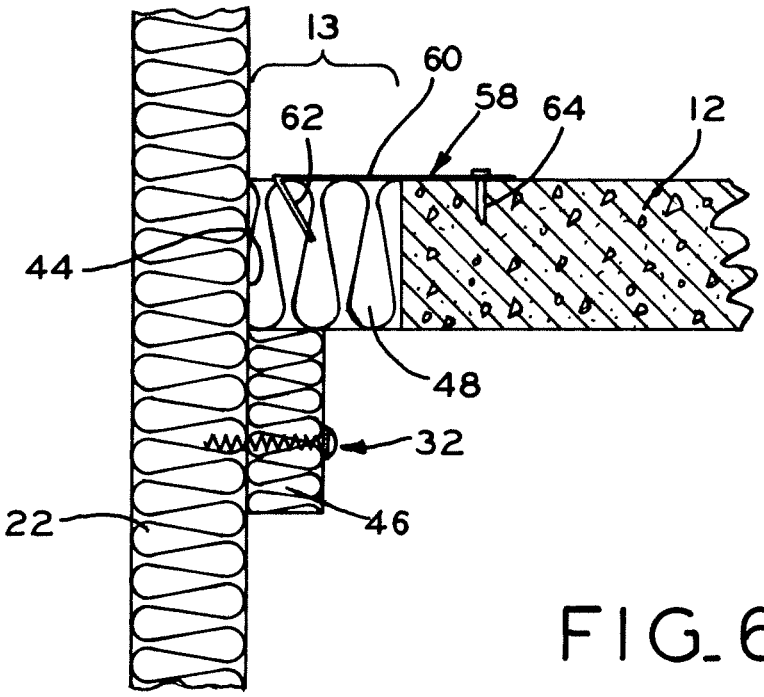
FIG. 6 is a fragmentary, cross-sectional view of another exemplary embodiment of an insulation system.

Referring to FIG. 6, another exemplary embodiment is shown which is substantially similar to the embodiment of FIG. 4 and like reference numerals have been used to identify identical or substantially identical parts between the different embodiments. Referring to FIG. 6, instead of Z-clip 50, the embodiment of FIG. 6 utilizes compression clip 58 to secure compressed safing insulation 48 in position. Compression clip 58 includes planar body portion 60 and arm 62, which extends from body portion 60 to form an acute angle relative to body portion 60. In one exemplary embodiment, compression clip 58 includes a plurality of arms 62 (not shown), which cooperate to secure compressed safing insulation 48 in position. Additionally, compression clip 58 may be secured to slab 12 by connector 64. Connector 64 may be any known fastener, such as a nail or screw. Advantageously, the use of compression clip 58 holds safing insulation 48 securely against slab 12 to prevent any breach of smoke, hot gasses, and/or fire between safing insulation 48 and slab 12.

Figure 5:
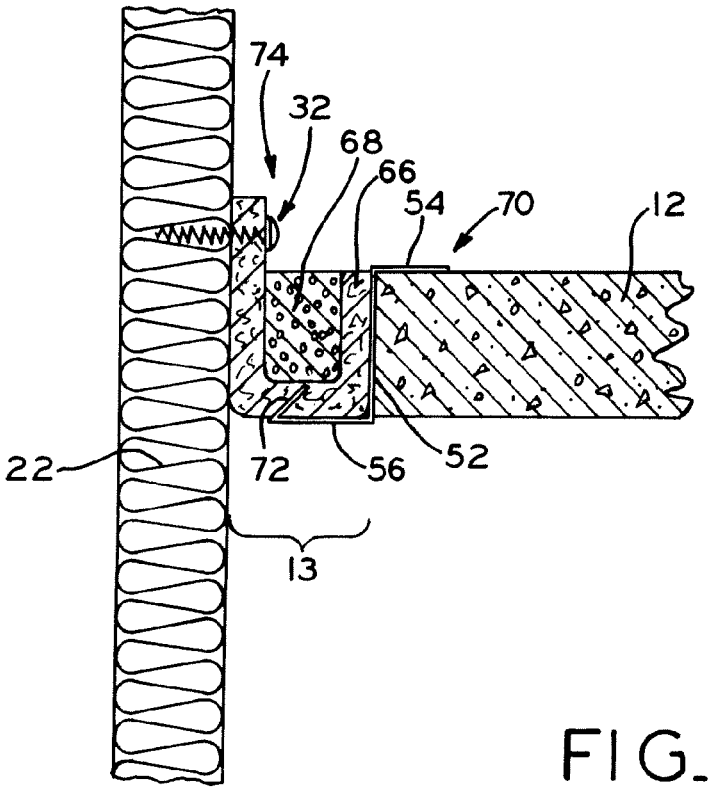
FIG. 5 is a fragmentary, cross-sectional view of another exemplary embodiment of an insulation system.

Referring to FIG. 5, another exemplary embodiment is shown in which gap 13 is spanned by a layer of needled felt 66. In order to secure needled felt 66 between slab 12 and main spandrel insulation 22, the first end of needled felt 66 adjacent slab 12 is secured in position using modified Z-clip 70. Alternatively, the first end of needled felt 66 adjacent slab 12 may be secured directly to the face and/or top surface of slab 12 using a fastener, such as a screw. Referring to modified Z-clip 70, modified Z-clip 70 is substantially similar to Z-clip 50 and like references numerals have been used to identify corresponding parts therebetween. Specifically, modified Z-clip 70 includes body 52, upper arm 54, and lower arm 56, all of which are substantially similar to Z-clip 50. However, modified Z-clip 70 further includes angled arm 72 which extends upwardly from lower arm 56 and is angled toward body 52 of modified Z-clip 70. By inserting angled arm 72 and lower arm 56 of modified Z-clip 70 through a portion of needled felt 66 and placing upper arm 54 of Z-clip 70 adjacent slab 12, the first end of needled felt 66 is secured to slab 12. The opposing, second end of needled felt 66 is secured to main spandrel insulation 22 using spiral anchor 32. As shown in FIG. 5, the opposing ends of needled felt 66 are secured to slab 12 and main spandrel insulation 22 with slack therebetween, i.e., the width of needled felt 66 between the first end and the second end is substantially greater than the width of gap 13. In this manner, needled felt 66 forms a substantially U-shaped trough 74. In another exemplary embodiment, needled felt 66 may be secured in position, as described in detail above, using Z-clip 50.

Positioned within U-shaped trough 74 is loose mineral wool 68. The combination of loose mineral wool 68 and needled felt 66 provides a barrier to delay and/or prevent the passage of smoke, hot gasses, and/or fire through gap 13 defined between slab 12 and main spandrel insulation 22. Thus, to the extent that main spandrel insulation 22 is deformed, such as during a fire, needled felt 66 will extend outwardly and continue to span gap 13. As opposing ends of needled felt 66 move away from one another, the depth of U-shaped trough 74 will be decrease and, correspondingly, the depth of loose mineral wool 68 within U-shaped trough 74 will decrease. However, even when main spandrel insulation 22 is deformed, the depth of mineral wool 68 will be sufficient to delay and/or prevent the passage of smoke, hot gasses, and/or fire through gap 13.

Figure 7:
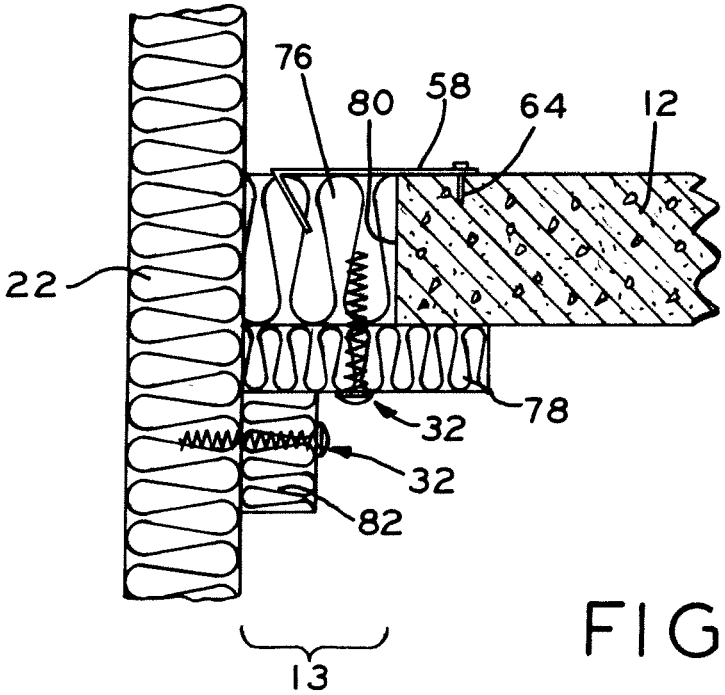
FIG. 7 is a fragmentary, cross-section view of yet another exemplary embodiment of an insulation system.

Referring to FIG. 7, another exemplary embodiment is shown in which compressed safing insulation 76 is positioned within the gap between slab 12 and main spandrel insulation 22. In one exemplary embodiment, compressed safing insulation 76 is secured in position using a compression clip, such as compression clip 58 described in detail above. Fixed spandrel insulation 78 is positioned below and adjacent to compressed safing insulation 76 and is sized to extend substantially entirely between opposing mullions 16 (FIG. 1). Fixed spandrel insulation 78 is secured to compressed safing insulation 76, such as by spiral anchor 32, and is sized to extend from main spandrel insulation 22 across junction 80 formed between compressed safing insulation 76 and slab 12. In this manner, in the event that compressed safing insulation 76 causes main spandrel insulation 22 to deform, fixed spandrel insulation 78 provides a barrier to the passage of smoke, hot gasses, and/or fire through junction 80 between compressed safing insulation 76 and slab 12. Positioned below and adjacent to fixed spandrel insulation 78 is fixed spandrel insulation 82. Fixed spandrel insulation 82 is sized to extend substantially entirely between opposing mullions 16 (FIG. 1). Fixed spandrel insulation 82 is secured to main spandrel insulation 22, such as by spiral anchor 32, and provides a barrier to the passage of smoke, hot gasses, and/or fire through the junctions between both compressed safing insulation 76 and main spandrel insulation 22 and fixed spandrel insulation 78 and spandrel 22. Thus, irrespective of the position of main spandrel insulation 22, fixed spandrel insulation 78, 82 cooperate to prevent the passage of smoke, hot gasses, and/or fire through the junctions between compressed safing insulation 76, slab 12, and main spandrel insulation 22.

While the embodiment shown in FIG. 7 is described as including compression clip 58 for securing safing insulation 76 in position and spiral anchor 32 for securing spandrel insulation 78 in position, these components, i.e., compression clip 58 and spiral anchor 32, may, in another exemplary embodiment, be eliminated. In this embodiment, only spiral anchor 32, which is positioned through spandrel insulation 82 to secure spandrel insulation 82 to main spandrel insulation 22, is used. As a result, spandrel insulation 78 and safing insulation 76 are supported atop spandrel insulation 82, which, as indicated above, is held in position by spiral anchor 32.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fire containment system for use in a building having an exterior wall system, the exterior wall system having a spandrel, the exterior wall system positioned a distance from a slab, wherein the distance between the spandrel and the slab defines a gap therebetween, the fire containment system comprising:

a portion of main spandrel insulation positioned within the gap defined between the spandrel and the slab;

a portion of compressed safing insulation positioned within the gap between said portion of main spandrel insulation and the slab, said portion of compressed safing insulation forming a spandrel junction with said portion of main spandrel insulation and a slab junction with the slab, said portion of compressed safing insulation having an upper surface and a lower surface; and a first, additional portion of spandrel insulation positioned adjacent to and abutting said portion of main spandrel insulation, said first, additional portion of spandrel insulation positioned adjacent to and abutting one of said upper surface and said lower surface of said portion of compressed safing insulation, said first, additional portion of spandrel insulation fixedly secured to said portion of main spandrel insulation, wherein movement of said portion of main spandrel insulation results in corresponding movement of said first, additional portion of spandrel insulation, and wherein movement of said portion of main spandrel insulation in a direction away from the slab creates a space at said spandrel junction and said first, additional portion of spandrel insulation restricts the passage of smoke, hot gasses, and fire through the space created at said spandrel junction.

2. The fire containment system of claim 1, further comprising a spiral anchor having a body and a head, said body of said spiral anchor positioned at least partially within said first, additional portion of spandrel insulation and said portion of main spandrel insulation, said head of said spiral anchor positioned adjacent to said first, additional portion of spandrel insulation, wherein said spiral anchor fixedly secures said first, additional portion of spandrel insulation to said portion of main spandrel insulation.

3. The fire containment system of claim 1, further comprising an anchor imbedded in said first, additional portion of spandrel insulation and imbedded in said portion of main spandrel insulation to fixedly secure said first, additional portion of spandrel insulation to said portion of main spandrel insulation.

4. The fire containment system of claim 3, further comprising a second, additional portion of spandrel insulation positioned adjacent to and abutting said portion of main spandrel insulation, said second, additional portion of spandrel insulation positioned adjacent to and abutting one of said upper surface and said lower surface of said portion of compressed safing insulation, said second, additional portion of spandrel insulation fixedly secured to said portion of main spandrel insulation, wherein movement of said portion of main spandrel insulation results in corresponding movement of said second, additional portion of spandrel insulation.

5. The fire containment system of claim 4, further comprising a first spiral anchor having a body and a head, said body of said first spiral anchor positioned at least partially within said first, additional portion of spandrel insulation and said portion of main spandrel insulation, said head of said first spiral anchor positioned adjacent to said first, additional portion of spandrel insulation, wherein said first spiral anchor fixedly secures said first, additional portion of spandrel insulation to said portion of main spandrel insulation.

6. The fire containment system of claim 5, further comprising a second spiral anchor having a body and a head, said body of said second spiral anchor positioned at least partially within said second, additional portion of spandrel insulation and said portion of main spandrel insulation, said head of said second spiral anchor positioned adjacent to said second, additional portion of spandrel insulation, wherein said second spiral anchor fixedly secures said second, additional portion of spandrel insulation to said portion of main spandrel insulation.

7. The fire containment system of claim 3, further comprising a compression clip, said compression clip secured to the slab and to said portion of compressed safing insulation, wherein said compression clip secures said portion of compressed safing insulation adjacent to the slab.

8. The fire containment system of claim 3, further comprising a Z-clip, said Z-clip having a first arm extending along an upper surface of the slab, a second arm received within said portion of compressed safing insulation, and an intermediate substantially vertical portion extending between said first arm and said second arm, said intermediate substantially vertical portion extending substantially along an end surface of the slab, wherein said Z-clip secures said portion of compressed safing insulation adjacent to the slab.

9. A fire containment system for use in a building having an exterior wall system, the exterior wall system having a spandrel, the exterior wall system positioned a distance from a slab, wherein the distance between the spandrel and the slab defines a gap therebetween, the fire containment system comprising:

a portion of main spandrel insulation positioned within the gap-defined between the spandrel and the slab;

a portion of compressed safing insulation positioned within the gap between said main spandrel insulation and the slab, said portion of compressed safing insulation forming a spandrel junction with said portion of main spandrel insulation and a slab junction with the slab, said portion of compressed safing insulation having an upper surface and a lower surface; and a first, additional portion of spandrel insulation positioned adjacent to and abutting one of said upper surface and said lower surface of said portion of compressed safing insulation, said first, additional portion of spandrel insulation fixedly secured to said portion of compressed safing insulation, said first, additional portion of spandrel insulation extending across said slab junction formed between said portion of compressed safing insulation and the slab, wherein said first, additional portion of spandrel insulation restricts the passage of smoke, hot gasses, and fire through said slab junction.

10. The fire containment system of claim 9, wherein said first, additional portion of spandrel insulation is positioned adjacent to and abutting said portion of main spandrel insulation.

11. The fire containment system of claim 9, further comprising a spiral anchor having a body and a head, said body of said spiral anchor positioned at least partially within said first, additional portion of spandrel insulation and said portion of compressed safing insulation, said head of said spiral anchor positioned adjacent to said first, additional portion of spandrel insulation, wherein said spiral anchor fixedly secures said first, additional portion of spandrel insulation to said portion of compressed safing insulation.

12. The fire containment system of claim 9, further comprising a second, additional portion of spandrel insulation positioned adjacent to and abutting said main spandrel insulation, said second, additional portion of spandrel insulation positioned adjacent to and abutting said first, additional portion of spandrel insulation, said second, additional portion of spandrel insulation fixedly secured to said portion of main spandrel insulation, wherein movement of said portion of main spandrel insulation results in corresponding movement of said second, additional portion of spandrel insulation.

13. The fire containment system of claim 12, further comprising a first spiral anchor having a body and a head, said body of said first spiral anchor positioned at least partially within said first, additional portion of spandrel insulation and said portion of compressed safing insulation, said head of said first spiral anchor positioned adjacent to said first, additional portion of spandrel insulation, wherein said first spiral anchor fixedly secures said first, additional portion of spandrel insulation to said portion of compressed safing insulation.

14. The fire containment system of claim 13, further comprising a second spiral anchor having a body and a head, said body of said second spiral anchor positioned at least partially within said second, additional portion of spandrel insulation and said portion of main spandrel insulation, said head of said second spiral anchor positioned adjacent to said second, additional portion of spandrel insulation, wherein said second spiral anchor fixedly secures said second, additional portion of spandrel insulation to said portion of main spandrel insulation.

15. The fire containment system of claim 9, further comprising a compression clip, said compression clip secured to the slab and to said portion of compressed safing insulation, wherein said compression clip secures said portion of compressed safing insulation adjacent to the slab.

16. The fire containment system of claim 9, further comprising a Z-clip, said Z-clip having a first arm extending along an upper surface of the slab, a second arm received within said portion of compressed safing insulation, and an intermediate substantially vertical portion extending between said first arm and said second arm, said intermediate substantially vertical portion extending substantially along an end surface of the slab, wherein said Z-clip secures said portion of compressed safing insulation adjacent to the slab.

17. A fire containment system for use in a building having an exterior wall system, the exterior wall system having a spandrel, the exterior wall system positioned a distance from a slab, wherein the distance between the spandrel and the slab defines a gap therebetween, the fire containment system comprising:

a portion of main spandrel insulation positioned within the gap defined between the spandrel and the slab;

a portion of compressed safing insulation positioned within the gap between said portion of main spandrel insulation and the slab, said portion of compressed safing insulation having an upper surface and a lower surface; and a first, additional portion of spandrel insulation positioned adjacent to and abutting said portion of main spandrel insulation, said first, additional portion of spandrel insulation positioned adjacent to and abutting one of said upper surface and said lower surface of said portion of compressed safing insulation to form a junction with said compressed safing insulation, said first, additional portion of spandrel insulation fixedly secured to said portion of main spandrel insulation, wherein movement of said portion of main spandrel insulation results in corresponding movement of said first, additional portion of spandrel insulation, and whereby, if movement of said portion of main spandrel insulation in a direction away from the slab creates a space at an end of said compressed safing insulation, said junction formed by said compressed safing insulation and said first additional portion of spandrel insulation restricts the passage of smoke, hot gasses, and fire through the space created.

18. The fire containment system of claim 17, further comprising an anchor imbedded in said first, additional portion of spandrel insulation and imbedded in said portion of main spandrel insulation to fixedly secure said first, additional portion of spandrel insulation to said portion of main spandrel insulation.

19. The fire containment system of claim 18, further comprising a second, additional portion of spandrel insulation positioned adjacent to and abutting said portion of main spandrel insulation, said second, additional portion of spandrel insulation positioned adjacent to and abutting one of said upper surface and said lower surface of said portion of compressed safing insulation, said second, additional portion of spandrel insulation fixedly secured to said portion of main spandrel insulation, wherein movement of said portion of main spandrel insulation results in corresponding movement of said second, additional portion of spandrel insulation.

20. The fire containment system of claim 19, further comprising a first spiral anchor having a body and a head, said body of said first spiral anchor positioned at least partially within said first, additional portion of spandrel insulation and said portion of main spandrel insulation, said head of said first spiral anchor positioned adjacent to said first, additional portion of spandrel insulation, wherein said first spiral anchor fixedly secures said first, additional portion of spandrel insulation to said portion of main spandrel insulation.

21. The fire containment system of claim 20, further comprising a second spiral anchor having a body and a head, said body of said second spiral anchor positioned at least partially within said second, additional portion of spandrel insulation and said portion of main spandrel insulation, said head of said second spiral anchor positioned adjacent to said second, additional portion of spandrel insulation, wherein said second spiral anchor fixedly secures said second, additional portion of spandrel insulation to said portion of main spandrel insulation.

22. The fire containment system of claim 18, further comprising a compression clip, said compression clip secured to the slab and to said portion of compressed safing insulation, wherein said compression clip secures said portion of compressed safing insulation adjacent to the slab.

23. The fire containment system of claim 18, further comprising a Z-clip, said Z-clip having a first arm extending along an upper surface of the slab, a second arm received within said portion of compressed safing insulation, and an intermediate substantially vertical portion extending between said first arm and said second arm, said intermediate substantially vertical portion extending substantially along an end surface of the slab, wherein said Z-clip secures said portion of compressed safing insulation adjacent to the slab.

24. The fire containment system of claim 17, further comprising a spiral anchor having a body and a head, said body of said spiral anchor positioned at least partially within said first, additional portion of spandrel insulation and said portion of main spandrel insulation, said head of said spiral anchor positioned adjacent to said first, additional portion of spandrel insulation, wherein said spiral anchor fixedly secures said first, additional portion of spandrel insulation to said portion of main spandrel insulation.

* * * * *

UNITED STATES PATENT AND TRADEMARK OFFICE

CERTIFICATE OF CORRECTION

PATENT NO. : 8,683,763 B2
APPLICATION NO. : 12/609106
DATED : April 1, 2014
INVENTOR(S) : James Shriver It is certified that error appears in the above-identified patent and that said Letters Patent is hereby corrected as shown below:

On the title page of the patent:

(73) Assignee: please delete "Owens Corning Intellectual Capital, LLC, Toledo, Ohio (US)" and replace with ---Thermafiber, Inc., Wabash, Indiana (US)---.

Signed and Sealed this
Third Day of November, 2015

Michelle K. Lee

Michelle K. Lee
*Director of the United States Patent and Trademark Office*